US005918990A

United States Patent [19]

Abumehdi

[11] Patent Number: 5,918,990

[45] Date of Patent: Jul. 6, 1999

[54] THERMAL TRANSFER PRINTING APPARATUS

[75] Inventor: Cyrus Abumehdi, Harlow, United Kingdom

[73] Assignee: Neopost Limited, Essex, United Kingdom

[21] Appl. No.: 09/013,609

[22] Filed: Jan. 26, 1998

[30] Foreign Application Priority Data

Jan. 31, 1997 [GB] United Kingdom ..... 9702098

[51] Int. Cl.[6] ..... B41J 2/315

[52] U.S. Cl. ..... 400/120.17; 400/120.01; 347/198; 73/81; 73/159

[58] Field of Search ..... 400/102.01, 55, 400/56, 120.17; 73/81, 159, 819; 347/201, 198

[56] References Cited

U.S. PATENT DOCUMENTS

| | | | |
|---|---|---|---|
| 3,683,681 | 8/1972 | Taylor | 73/78 |
| 3,756,151 | 9/1973 | Zofchak | 101/269 |
| 4,639,152 | 1/1987 | Yamamoto et al. | 400/120 |
| 4,661,824 | 4/1987 | Kuge | 346/70 PH |
| 4,883,375 | 11/1989 | Karube et al. | 400/55 |
| 4,947,183 | 8/1990 | Yagino | 347/201 |
| 5,051,008 | 9/1991 | Honda et al. | 400/59 |
| 5,077,564 | 12/1991 | Thomas | 347/201 |
| 5,297,062 | 3/1994 | Cresson et al. | 364/564 |
| 5,648,811 | 7/1997 | Thiel et al. | 347/220 |

FOREIGN PATENT DOCUMENTS

| | | |
|---|---|---|
| 0589722 A2 | 3/1994 | European Pat. Off. . |
| 2247213 | 2/1992 | United Kingdom . |

*Primary Examiner*—Edgar Burr
*Assistant Examiner*—Dave A. Ghatz
*Attorney, Agent, or Firm*—Shoemaker and Mattare, Ltd.

[57] ABSTRACT

A thermal print head has thermal print elements located along an edge of a substrate between two faces thereof. An impression roller resiliently urges a print receiving medium, for example a mail item in a postage meter, into ink transfer engagement with an ink layer of a thermal transfer ink ribbon and urges the ink ribbon into heat transfer engagement with the thermal print elements. The print head is mounted to be adjustable as to location of the line of print elements relative to the impression roller and the angular disposition of the print head. The resiliently pressure exerted by the impression is adjustable. Adjustment of the print head and of the pressure may be effected automatically in response to sensing of compressibility of the print receiving medium.

11 Claims, 2 Drawing Sheets

THERMAL TRANSFER PRINTING APPARATUS

BACKGROUND OF THE INVENTION

This invention relates to thermal transfer printing apparatus and in particular to obtaining optimum print quality with such apparatus.

Known thermal transfer printing apparatus comprises a print head having a plurality of selectively energisable thermal printing elements disposed in a line. A print receiving medium is fed in a direction transverse to the line of thermal printing elements. A thermal transfer ink ribbon is fed with the print receiving medium and interposed between the print receiving medium and the printing elements. The ink transfer ribbon carries a layer of ink and the ink ribbon is orientated such that the layer of ink is in contact with the print receiving medium. An impression roller is disposed in opposition to the line of printing elements and is resiliently biased toward the printing elements so as to bring the print receiving medium into intimate ink transfer engagement with the ink layer of the ribbon and to bring the ribbon into heat transfer engagement with the printing elements. During feeding of the print receiving medium and the ink ribbon, the thermal printing elements are selectively energised in a series of printing cycles to heat selected areas of the ink layer. The heating of the selected areas of the ink layer results in those selected areas of ink adhering to the print receiving medium and after passing the line of thermal printing elements the used ink ribbon is peeled from the print receiving medium to leave a required imprint consisting of the selected areas of ink on the print receiving medium.

Thermal transfer printing apparatus is used in postage meters to print postage indicia on mail items, the postage indicia imprint providing evidence that accounting for postage charges in respect of the mail items has been effected. Mail items may have a thickness within a relatively large range of thicknesses and hence, unlike printing apparatus for printing on sheets of paper having a thickness within a relatively restricted range of thicknesses, printing apparatus used in postage meters is required to be capable of printing on mail items having relatively large range of thicknesses. In printing apparatus for printing on sheets within a relatively restricted range of thicknesses the elements of the printing apparatus may be mounted and arranged to operate in a fixed unvarying relationship. However in printing apparatus for use in postage meters required to accommodate a relatively large range of thicknesses of mail items it has been found that optimum quality is not obtained in respect of mail items of differentthicknesses.

SUMMARY OF THE INVENTION

According to one aspect of the present invention thermal transfer printing apparatus includes a thermal print head comprising a substrate and a plurality of thermal printing elements carried by said substrate; said substrate having an edge between faces thereof and said plurality of thermal printing elements being disposed in a line extending along or immediately adjacent to said edge; impression means opposed to said edge of the print head for resiliently urging a print receiving medium into engagement with an ink layer of an ink ribbon extending between the print receiving medium and the row of thermal printing elements and for resiliently urging the ink ribbon into heat exchange engagement with the thermal printing elements; and control means operable to adjust at least one parameter as herein defined.

According to a second aspect of the present invention thermal transfer printing apparatus includes a thermal print head comprising a substrate and a plurality of thermal printing elements carried by said substrate; said substrate having an edge between faces thereof and said plurality of thermal printing elements being disposed in a line extending along or immediately adjacent to said edge; impression means opposed to said edge of the print head for resiliently urging a print receiving medium into engagement with an ink layer of an ink ribbon extending between the print receiving medium and the row of thermal printing elements and for resiliently urging the ink ribbon into heat exchange engagement with the thermal printing elements; sensing means responsive to softness or compressibility of the print receiving medium; and control means responsive to said sensing means to adjust at least one parameter of the printing apparatus as herein defined in dependence upon the sensed softness or compressibility of the print receiving medium.

BRIEF DESCRIPTION OF THE DRAWING

Thermal transfer printing apparatus embodying the present invention will be described hereinafter by way of example with reference to the drawings in which:—

DESCRIPTION OF THE PREFERRED EMBODIMENT

Figure 1:
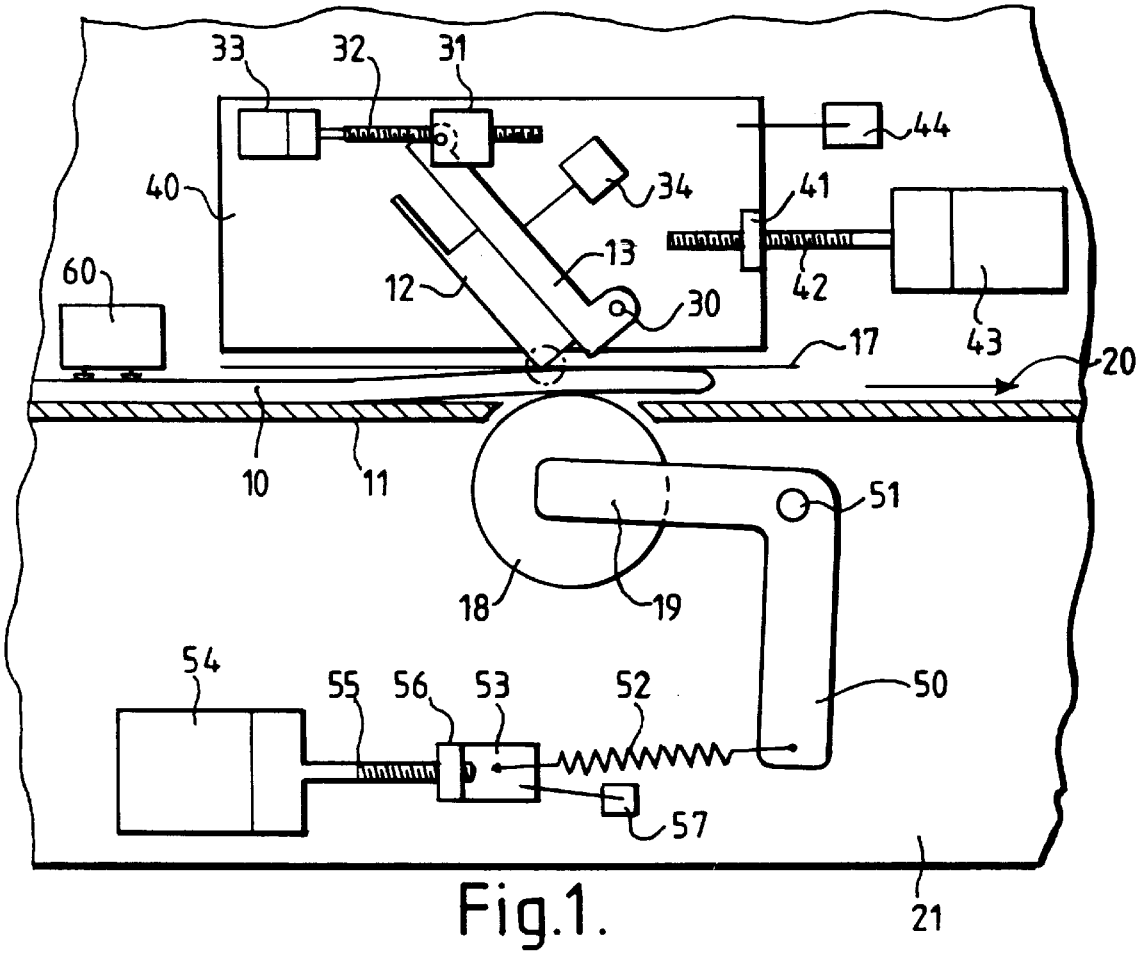
FIG. 1 illustrates thermal printing apparatus provided with means to optimise print quality in accordance with the invention.
Figure 2:
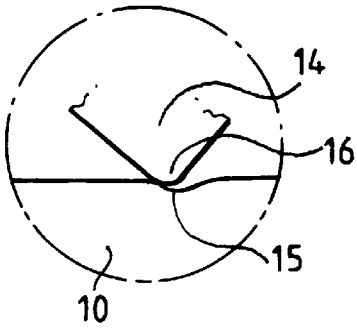
FIG. 2 illustrates to a larger scale the interaction between a print head of the printing apparatus of FIG. 1 and a mail item.

Referring first to FIGS. 1 and 2 of the drawings, a print receiving medium comprising a mail item 10 is fed, in the direction of arrow 20 along a feed bed 11 to receive an imprint. The printing is effected by means of a thermal print head 12 mounted in spaced relationship to the feed bed on a support member 13. The thermal print head includes a substrate 14 formed of ceramic and a plurality of thermal printing elements 15 disposed in a row extending along or adjacent an edge 16 between two adjacent faces of the substrate 14. A thermal transfer ink ribbon 17 is guided by guide means (not shown) between the row of thermal printing elements and the mail item 10. The ink ribbon comprises an ink carried on a thin flexible substrate and the ink ribbon is orientated such that the ink layer lies in contact with a surface of the mail item. An impression roller 18 is mounted for rotation about an axis 19 in opposition to the line of thermal printing elements 15, the axis of rotation of the impression roller extending parallel to the line of printing elements. The impression roller is resiliently urged toward the printing elements to press the mail item into intimate ink transfer engagement with the ink layer of the ribbon and to press the ink ribbon into heat transfer engagement with the thermal printing elements. The print head is mounted with an angled orientation so that the edge 16, and the thermal printing elements adjacent thereto, projects towards the feed bed and the ink ribbon and mail item. The edge 16 of the substrate 14 of the print head is curved with a relatively small radius, as shown in FIG. 2, to assist in passage of the ink ribbon, in engagement with this edge, past the print head. Selective and repeated energisation of the thermal printing elements with an electric current causes heating of the thermal printing elements. The heating of the thermal printing elements results in heating of selected areas of the ink layer of the ink ribbon and the heated areas of ink layer adhere more strongly to the mail item than the unheated parts of the ink layer. After passing the print head, the ink ribbon is peeled by guide means (not shown) and the selected areas of the ink layer which have been subjected to heating remain adhered to the mail item and form an imprint whereas the unheated parts of the ink layer adhere to the substrate of the ribbon and are peeled away from the mail item.

The impression roller 18 is driven by drive means (not shown) and frictional engagement of the peripheral surface of the impression roller with the mail item feeds the mail item past the thermal printing elements of the print head. The engagement of the mail item with the ink layer of the ribbon provides a frictional force to the ink ribbon to feed the ink ribbon with and at the same speed as the mail item.

The feed bed 11 is secured to a chassis 21 and the print head and impression roller are mounted on the chassis and are movable relative to the chassis 21.

When the print receiving medium is relatively non-compressible the pressure on the print receiving medium at the line of engagement between the print receiving medium, the ink ribbon and the edge of the print head is insufficient to result in significant distortion of the print receiving medium. However when the print receiving medium is relatively soft or compressible, the surface of the print receiving medium is distorted, as shown in FIG. 2, due to dragging of the print receiving medium against the relatively sharp edge 16 of the print head. A result of the distortion of the print receiving surface is a reduction in the engagement of the print receiving medium, the ink ribbon and the printing elements with consequent reduction in quality of the imprint on the print receiving medium. Generally, when the print receiving medium is a single sheet of paper, the paper is relatively non-compressible, optimum engagement between the print receiving medium, the ink ribbon and the printing elements is attained and a required quality of imprint is obtained. However when it is necessary to print on a print receiving medium which is relatively soft and compressible, the distortion of the print receiving medium results in reduction of the print quality obtained. Postage meters utilised for metering postage value are required to print on mail items and the mail items may have a range of thicknesses and composition. For example a mail item may comprise an envelope containing a single unfolded insert sheet or may comprise an envelope containing one or more folded insert sheets. As a result the printing device needs to be capable of producing a desired quality of imprint not only on a relatively non-compressible mail item comprising an envelope containing a single unfolded sheet but also on a relatively compressible mail item comprising an envelope containing a number of folded sheets.

It has been found that a desired quality of imprint may be obtained on items of a range of thicknesses and compositions if one or more of a number of parameters of the printing device are adjusted. The parameters of which one or more need to be adjusted to obtain the desired quality of imprint for a range of print receiving media are the angular orientation of the print head relative to the plane of the feed bed, the relative position of the edge 16 of the print head and the impression roller in the direction of feeding of the print receiving medium and the pressure exerted on the print receiving medium by the impression roller. Adjustment of the parameters may be effected manually by an operator of the postage meter in dependence upon the perceived composition of the mail item. However manual setting of the parameters is inconvenient and the operator may neglect to set the parameters for optimum quality of imprint. Accordingly it is proposed to sense the mail item prior to printing thereon and to utilise the result of said sensing to effect appropriate adjustment of one or more of the parameters.

Referring particularly to FIG. 1, the angular orientation of the print head is effected by pivotally mounting the support member 13 at pivot 30 and connecting the support member 13 to nut 31 and leadscrew mechanism 32 drivable by a motor 33. By operation of the motor 33, the leadscrew 32 is rotated relative to the nut 31 to move the nut along the leadscrew. As a result the angle of orientation of the support member 13 and print head 12 may be changed. Accordingly the angle of engagement of that part of the print head in the region of the edge 16 and printing elements 15 by the ink ribbon, and indirectly by the mail item, may be varied by selectively energising the motor 33. It will be appreciated that the motor 33 is mounted to allow pivoting thereof and the nut 31 is connected pivotally to the support member 13. A sensor 34 is mechanically connected to the support member 13 to provide electrically signals indicative of the angular orientation for the print head.

The relative position of the edge 16 and the printing elements of the print head and the impression roller 18 may be adjusted by mounting the print head on a sub-chassis 40. The sub-chassis is movable relative to the chassis 21 in a direction parallel to the feed bed 11. The location of the sub-chassis 40 relative to the chassis 21 is adjustable by means of a nut 41 and leadscrew 42 mechanism, the leadscrew 42 being rotatable by a drive motor 43. Accordingly by selective energisation of the drive motor 43, the position of the sub-chassis and hence of the edge 16 of the print head relative to the impression roller may be adjusted. A sensor 44 mechanically connected to the sub-chassis provides electrical signals indicative of the position of the edge 16 of the print head.

The pressure exerted by the impression roller on the mail item may be adjusted by variation of the extension of a spring resiliently exerting a force on the impression roller. As shown in FIG. 1, the impression roller 18 is supported on a cradle 50 consisting of a pair of levers pivotally mounted at 51 to the chassis 21. An extension spring 52 is connected at one end to the cradle 50 and at the other end to an adjustable anchor 53. The spring 52 normally is under tension so as to apply a force via the cradle 50 to the impression roller resiliently urging the impression roller toward the printing element of the print head. The force applied by the spring 52 to the impression roller is adjustable by adjustment of the location of the anchor 53 relative to the cradle 50. Adjustment of the location of the anchor 53 is effected by a selectively operable drive motor 54 mechanically connected to the anchor through a leadscrew 55 and nut 56. A sensor 57 is mechanically connected to the anchor 53 to provide electrical signals indicative of the position of the anchor and hence of the pressure exerted by the impression roller on the mail item.

Usually, the impression roller is movable between an operative position in which it is resiliently urged into engagement with a mail item, as shown in FIG. 1, and an inoperative position in which the impression roller is retracted away from the print head to permit free passage of a mail item between the print head and the feed bed. Means may be provided to move the cradle 50 toward and away from the print head or, if desired, the drive motor 54 may be operated selectively to cause spring force to be applied to the impression roller and to relieve the spring pressure to permit the impression roller to retract to the inoperative position.

It will be appreciated that parameters of the printing device including angular and positional relationships of elements of the printing device are adjustable.

Parameters which are adjustable include the angular relationship of the print head to the impression roller and the direction of feeding of the print receiving medium, the relative location of the print head and the impression roller in the direction of feeding of the print receiving medium and the force with which the impression roller is urged toward the print head. Where required, parameters other than those defined hereinbefore may be adjustable. These adjustments of the parameters of the printing device may be accomplished by mechanical means other than those described hereinbefore and it is to be understood that the invention is not limited to the specific mechanical means illustrated in the drawings and described hereinbefore with reference to the drawings. For example, instead of the print head being mounted on a sub-chassis movable relative to the chassis and impression roller, the impression roller may be mounted on a sub-chassis movable relative to the chassis and print head.

Figure 3:
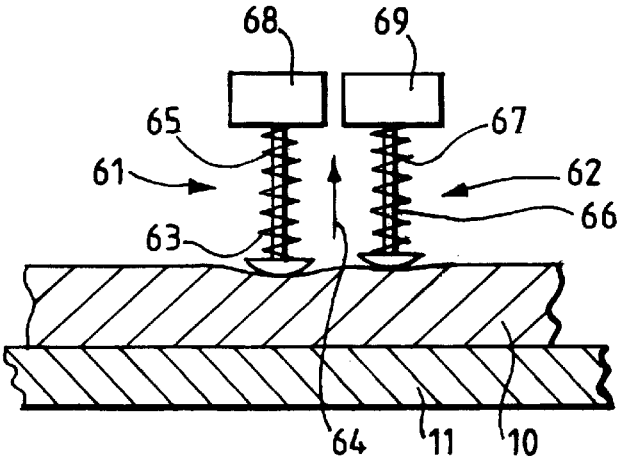
FIG. 3 illustrates a mail sensing means for use in the apparatus of FIG. 1.

Adjustment of the parameters of the printing device may be effected by operator control of selective energisation of the drive motors 33, 43 and 54. However, it is preferred that adjustment of the parameters be effected in dependence upon sensing of the mail item. Accordingly a sensor 60 is mounted upstream, in the direction of feed, of the print head. Construction and operation of the sensor 60 will now be described with reference to FIG. 3 of the drawings. The sensor 60 includes a first sensing device 61 and a second sensing device 62 similar to the first sensing device. The first sensing device 61 includes a plunger 63 displaceable in the direction of arrow 64 against the action of a spring 65 by engagement therewith of a mail item 10 supported on the feed bed 11. Similarly the second sensing device 62 includes a plunger 66 displaceable in the direction of arrow 64 against the action of a spring 67 by engagement therewith of the mail item 10 supported on the feed bed 11. Mechanical to electrical transducing means 68 and 69 generate electrical signals indicative of the displacement of the plungers 63, 66 respectively. The springs 65, 67 have different rates so that the difference of displacement of the plungers 63, 66 by engagement therewith of the mail item provides an indication of the compressibility or softness of the mail item and the combined displacement of the plungers 63, 66 by engagement therewith of the mail item provides an indication of the thickness of the mail item.

Figure 4:
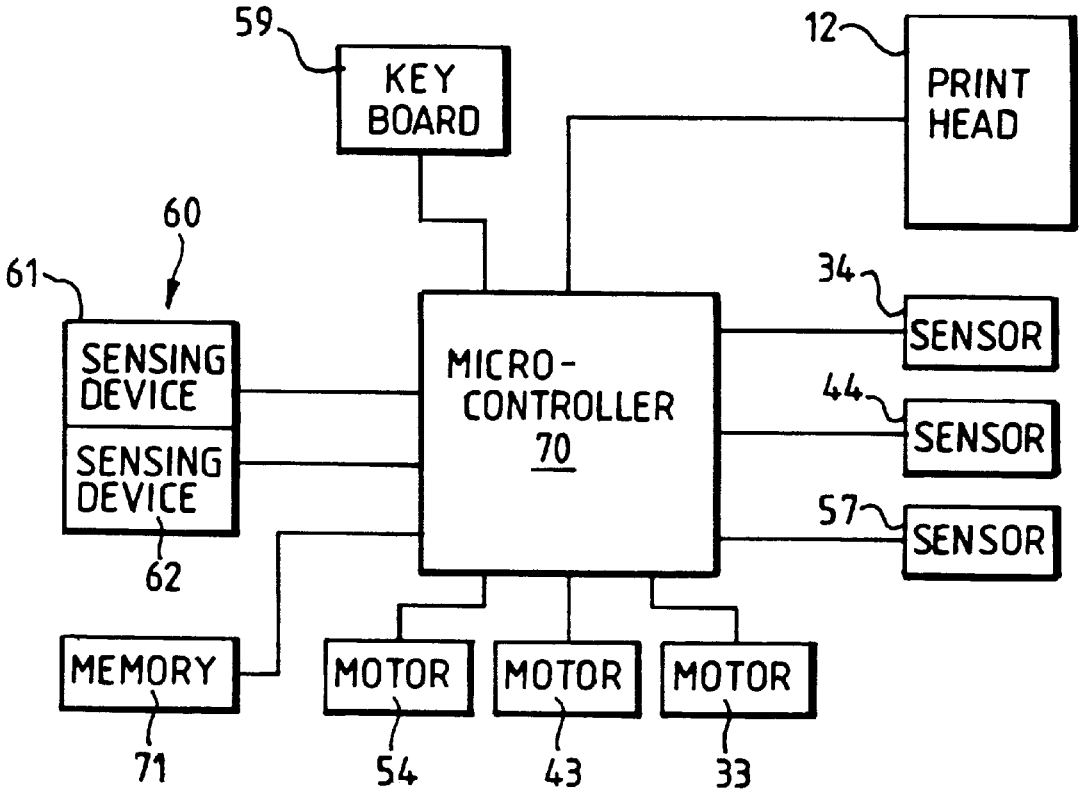
FIG. 4 is a block circuit diagram of control means for the thermal printing apparatus.

Referring now to FIG. 4, a microcontroller 70 receives signals from the sensing devices 61, 62 indicative of the compressibility and thickness of the mail item. A memory 71 stores a look up table relating ranges of settings of the parameters of the printing device required in relation to a range of softnesses and a range of thicknesses of mail item. In response to the indications from the sensing devices 61, 62, the microcontroller utilises the look up table to determine required values of parameters of the printing device required to obtain optimum quality of imprint on the mail item being sensed by the sensing devices 61, 62. The microcontroller then selectively energises the drive motors 33, 43, 54 until the sensors 34, 44, 57 respectively provide indications that the adjustable parameters of the elements of the printing device have been set to the required settings.

If it is desired to permit operator control of the parameters, this may be effected by means of operator input via a keyboard 59 to the micro-controller 70.

We claim:

1. Thermal transfer printing apparatus including a thermal print head comprising a substrate and a plurality of thermal printing elements carried by said substrate; first and second adjacent faces of said substrate; said second face being inclined relative to said first face; an edge between said first and second faces of said substrate; said plurality of thermal printing elements being disposed in a line extending along said edge; impression means opposed to said edge of the print head and operable to resiliently urge a print receiving medium into engagement with an ink layer of an ink ribbon extending between the print receiving medium and the row of thermal printing elements and to resiliently urge the ink ribbon into heat exchange engagement with the thermal printing elements; said print head and said impression means having a determined relationship to one another, said determined relationship having at least one parameter; sensing means responsive to compressibility of the print receiving medium to output a first output signal representing compressibility of the print receiving medium; and control means operative in response to said first output signal to adjust said at least one parameter of the determined relationship between the print head and the impression means in dependence upon the compressibility of the print receiving medium.

2. Thermal transfer printing apparatus as claimed in claim 1 wherein said at least one parameter is a first parameter, said first parameter is angular orientation of the substrate of the print head relative to a direction of feeding of the print receiving medium and the control means is operative in response to the first output signal to adjust the angular orientation of the substrate of the print head.

3. Thermal transfer printing apparatus as claimed in claim 1 including an axis extending substantially parallel to the line of printing elements, the impression means being rotatable about said axis wherein said at least one parameter is a second parameter, said second parameter is location of the line of printing elements relative to said axis in a direction perpendicular to said line of printing elements and the control means is operative in response to the first output signal to adjust the second parameter.

4. Thermal transfer printing apparatus as claimed in claim 1 wherein said at least one parameter is a first parameter, said third parameter is resilient force applied to urge the impression means toward the line of printing elements and the control means is operative in response to the first output signal to adjust the third parameter.

5. Thermal transfer printing apparatus as claimed in claim 1 wherein the sensing means comprises first detection means to generate a first sensing signal in response to a first compression of the print receiving medium; second detection means to generate a second sensing signal in response to a second compression, different from said first compression, the print receiving medium; and signal processing means responsive to said first and second sensing signals to generate the first output signal representing compressibility of the print receiving medium and to generate a second output signal representing thickness of the print receiving medium and wherein the control means is operative in response to the first and second output signals to adjust said at least one parameter in dependence upon the compressibility and upon the thickness of the print receiving medium.

6. Thermal transfer printing apparatus as claimed in claim 5 wherein the control means is operative in response to the first and second output signals to adjust angular orientation of the substrate of the print head.

7. Thermal transfer printing apparatus as claimed in claim 5 wherein the control means is operative in response to the first and second output signals to adjust relative location of the print head to the impression means.

8. Thermal transfer printing apparatus as claimed in claim 5 wherein the control means is operative in response to the first and second output signals to adjust resilient force applied to the impression means urging the impression means toward the line of printing elements.

9. Thermal transfer printing apparatus including a thermal print head comprising a substrate and a plurality of thermal printing elements carried by said substrate; first and second faces of said substrate; an edge extending along an intersection between said first and second faces of said substrate; said plurality of thermal printina elements being disposed in a line extending adjacent to said edge; impression means opposed to said edge of the print head for resiliently urging a print receiving medium into engagement with an ink layer of an ink ribbon extending between the print receiving medium and the row of thermal printing elements and for resiliently urging the ink ribbon into heat exchange engagement with the thermal printing elements; said print head and said impression means having a determined relationship to one another, said determined relationship having at least one parameter; sensing means responsive to compressibility of the print receiving medium to output a signal indicative of compressibility of the print receiving medium; and control means operative in response to said signal output by said sensing means to adjust said at least one parameter of the determined relationship between the print head and the impression means in dependence upon the compressibility of the print receiving medium wherein the sensing means includes a first spring having a first rate; a second spring having a second rate; a first element displaceable against said first spring by engagement with the print receiving medium; a second element displaceable against said second spring by engagement with the print receiving medium; the first rate of said first spring being different from the second rate of the second spring whereby a difference in displacements of the first and second elements indicates compressibility of the print receiving medium and a sum of the displacements of the first and second elements indicates thickness of the print receiving medium.

10. Thermal transfer printing apparatus as claimed in claim 9 wherein the control means includes a stored table of parameters of relative positional relationships of the impression means and the edge of the print head corresponding to a range of signals output by the sensing means and wherein the control means is operative in response to the signal output by the sensing means to determine from said stored table the parameters of the relative positional relationship of the impression means and the edge of the print head corresponding to the signal and to adjust the positional relationship of said print head and said impression means to the determined positional relationship corresconding to the parameters determined from said table.

11. Thermal transfer printing apparatus as claimed in claim 9, wherein the control means includes a stored table of values of parameters corresponding to a range of signals output by the sensing means and wherein the control means is operative in response to the signal output by the sensing means to determine from said stored table the corresponding value of at least one parameter and to adjust said parameter to the determined value.

* * * * *